United States Patent [19]

Cullity

[11] Patent Number: 4,494,327

[45] Date of Patent: Jan. 22, 1985

[54] SIGHTING DEVICE FOR FIREARMS AND THE LIKE

[76] Inventor: W. Daniel Cullity, 209 Old County Rd., E. Sandwich, Mass. 02537

[21] Appl. No.: 406,206

[22] Filed: Aug. 9, 1982

[51] Int. Cl.[3] ..... F41G 1/32

[52] U.S. Cl. ..... 42/1 S; 33/241

[58] Field of Search ..... 42/1 S; 33/233, 241, 33/242, 243

[56] References Cited

U.S. PATENT DOCUMENTS

| | | | |
|---|---|---|---|
| 355,121 | 12/1886 | Bennett | 33/242 |
| 1,346,303 | 7/1920 | Dawson et al. | 33/241 |
| 2,112,268 | 3/1938 | Burton | 42/1 S |
| 2,706,335 | 4/1955 | Munsey | 33/241 |
| 2,932,896 | 4/1960 | Hicinbothem | 42/1 S |

*Primary Examiner*—Charles T. Jordan

*Attorney, Agent, or Firm*—Thomas C. O'Konski; Robert A. Cesari; John F. McKenna

[57] ABSTRACT

A sighting device for use with firearms and the like under varied ambient light conditions comprises a base member for mounting relative to a firearm or the like and an upstanding sight member. The sight member includes an intermediate surface that has a reflective finish and that is inclined upwardly and rearwardly so as to reflect ambient light from above rearwardly toward a sighter's eye. The rear end of the sight member defines a through aperture and is dimensioned so that it masks the inclined reflective surface from view from the rear except for that portion thereof that is exposed through the aperture. The aperture and inclined reflective surface combine to present a bright bead contained in the relatively dark border of the rear face of the sight member which is useful in attaining an accurate sight under both bright and dim ambient light conditions. A front sight embodiment having a single aperture and a rear sight embodiment having two spaced apart apertures are disclosed.

16 Claims, 9 Drawing Figures

SIGHTING DEVICE FOR FIREARMS AND THE LIKE

BACKGROUND OF THE INVENTION

This invention relates generally to sighting or aiming devices and, more particularly, to a sighting device for firearms and the like which is useful in sighting under both bright and dim ambient light conditions.

A recognized problem in the sighting or aiming of firearms and other similar equipment is the difficulty encountered when attempting to use the equipment under varied ambient light conditions. For example, firearms frequently are equipped with so-called metallic sight pairs including a front blade sight that is mounted near the end of the barrel of the firearm, and a rear notch sight that is mounted in proximity to the chamber or cylinder of the firearm, closer to the shooter's eye. In sighting, the blade of the front blade sight is typically aligned and centered in the notch of the rear sight, with the target image positioned directly above the blade. Such metallic sight pairs are generally useful in moderate to bright ambient light conditions. In dim ambient light conditions, however, difficulty is typically encountered in discerning and locating the sights relatively to one another, particularly the front blade sight which is spaced farther from the shooter's eye.

While a wide variety of devices have been proposed heretofore to alleviate the above and related difficulties in sighting, few, if any, of these prior devices have encountered any significant degree of commercial acceptance. One class of prior devices is exemplified by those shown in U.S. Pat. Nos. 2,385,649; 3,678,590; 3,833,799; 3,994,072. As is evident from a review of these patents, these devices utilize an independent light source to illuminate one or more parts of the sighting equipment, and are designed to be attached to the firearm when use under low ambient light conditions is anticipated. Such devices are disadvantaged not only because of their relative complexity and high cost, but also because of their rather obtrusive and unconventional appearance when mounted to the firearm. As a result of this, such devices are typically attached and used only under the highly specialized condition of low ambient light, and rarely left on the firearm as a permanent fixture for use under any condition.

Another class of prior devices is exemplified by those shown in U.S. Pat. Nos. 1,292,211; 1,307,063; 2,246,174; 2,822,616; 2,987,821; 3,218,718; and 3,641,676. These devices utilize one or another form of a self-luminous substance, such as an iridescent, phosphorescent, fluorescent or radioluminescent material, that is painted or otherwise deposited on parts of the sight to illuminate them. While such devices are generally simplier and less expensive than the independently illuminated devices discussed above, they too are disadvantaged. Specifically, the self-luminous substance used in such devices can be scratched or can wear off the sight parts, or lose its light emitting capability, over time and in normal use of the firearm.

Still another class of prior sighting devices or aids is represented by U.S. Pat. Nos. 1,346,303; 2,706,335; 3,362,074; and 3,439,970. These devices utilize bodies of transparent material, such as optical grade glass or plastic, which are mounted as part of the sighting element and which are shaped and configured like prisms or lenses to collect, concentrate and/or focus ambient light so as to provide improved sighting conditions. Like the devices of the first class mentioned above, these devices are relatively expensive to make, and rather obtrusive and unconventional in appearance when mounted to a firearm. Further, like the devices of the second class mentioned above, they are relatively delicate due to their susceptibility to scratching, breakage and wear in normal use of the firearm. These factors have militated against the widespread acceptance of such devices for firearms and other such sighted equipment.

OBJECTS OF THE INVENTION

Accordingly, it is an object of the present invention to provide an improved sighting device for firearms and other such equipment adapted to be sighted to a remote object.

It is another object of the invention to provide an improved sighting device that enables accurate sighting to be accomplished under varied ambient light conditions ranging from bright to dim.

Another object of the invention is to provide an improved sighting device of the above described type that has an unobtrusive, rather conventional appearance when mounted to a firearm.

Still another object of the invention is to provide an improved sighting device of the above described type that eliminates the need for independent light sources, self-luminous deposits, prisms, lenses and other such components.

Still yet another object of the invention is to provide an improved sighting device of the above described type that is relatively simple and rugged in construction, and that is relatively inexpensive to manufacture and durable in use.

Other objects will in part be specified in, and in part be obvious from the detailed description of illustrative embodiments of the invention set forth hereinbelow.

SUMMARY OF THE INVENTION

A sighting device embodied in accordance with the present invention comprises a sight member and a base member. The base member is used for mounting the device relative to a firearm or other such equipment which is to be sighted to a remote object. The sight member stands upwardly of the base member, and includes a front end adapted to face toward the remote object and away from a sighter's eye when sighting, and a rear end adapted to face toward the sighter's eye. The sight member includes, between its front and rear ends, a surface that is inclined rearwardly and upwardly relative to the line of sight of the firearm or other equipment to which the sighting device is mounted. This inclined surface, which in the preferred embodiment is inclined rearwardly and upwardly at an angle of about 45° relative to the line of sight, is coated or otherwise provided with a finish that is highly reflective of ambient light as compared to the remaining surfaces of the sighting device. The rear end of the sight member defines at least one small diameter masking aperture extending generally parallel to the line of sight which exposes only a portion of the inclined, reflective surface when the device is viewed from the rear.

Light from above the sighting device impinges upon the inclined, reflective surface of the sight member from which it is reflected rearwardly. Only that portion of the reflected light that passes through the aperture generally parallel to the line of sight is visible from the rear of the device. By selecting an appropriate size for the aperture, the light that is reflected from the inclined, reflective surface can be made to appear as a sharply defined, fringeless bead which is substantially brighter than the background presented by the rear end of the sight member. Under bright ambient light conditions, the background presented by the rear end of the sight member is well defined and clearly discernible, as is the bright bead contained therein, and both can be used effectively in sighting to a remote object. More importantly, however, even under relatively dim ambient light conditions in which the background presented by the rear end of the sight member becomes blurry and fades into the image of the remote object being sighted to, the bead still remains relatively bright and sharply defined, permitting accurate sighting to be accomplished using the bead. It is only under extremely low ambient light conditions that the bead becomes so dull and indiscernible as to be useless for sighting. The device thus substantially broadens the effective range of ambient light intensities over which accurate sighting can be accomplished.

The sighting device of the invention may be used by itself, in combination with a conventional metallic sight, or in combination with a second sighting device embodied in accordance with the invention. Even when the device is used by itself, sighting errors in windage and elevation can be readily detected since the apparent intensity of the light that passes rearwardly through the aperture decreases as the sighter's eye moves off of the line of sight. The sighting device of the invention can also be economically machined as an integral unit from metal, with the reflective finish being provided by a thin plating of gold, polished brass or other such highly reflective, wear resistant material, making the device both inexpensive to make and durable in use. These advantages, combined with the rather conventional appearance which the device exhibits when mounted, permit the devices to be used as permanent fixtures on any of a wide variety of firearms and related equipment.

BRIEF DESCRIPTION OF THE DRAWING

The foregoing and other objects, features and advantages of the invention will be better understood from the following detailed description taken with the accompanying drawing in which.

DETAILED DESCRIPTION OF ILLUSTRATIVE EMBODIMENTS

Figure 1:
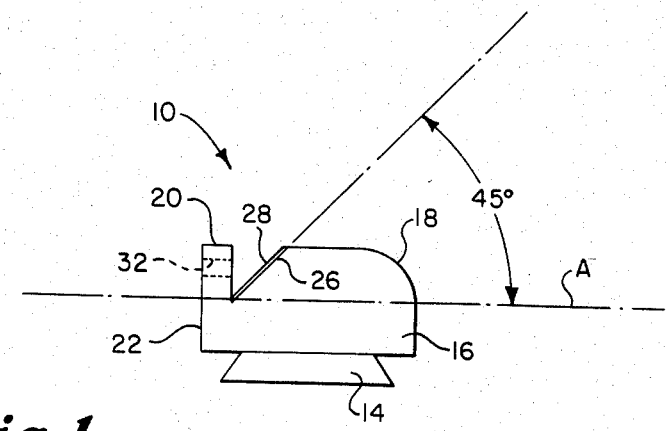
FIG. 1 is a side view of a sighting device embodied in accordance with the invention which is particularly adapted for use as a front blade firearm sight.
Figure 2:
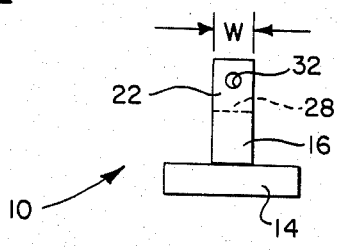
FIG. 2 is a rear end view of the sighting device of FIG. 1.

Referring now specifically to the drawing, and initially to FIGS. 1 and 2 thereof, there is shown a sighting device 10 embodied in accordance with this invention. The device 10 is particularly adapted for use in conjunction with firearms, and will be described hereinafter in that specific context. It will be appreciated, however, that the device 10 may be adapted for use in conjunction with other equipment that requires accurate sighting to a remote object, such as, for example, leveling and distance measuring equipment of the type used in surveying and construction.

The sighting device 10 comprises a base member 14 which has generally rectilinear sides (FIG. 2), and ends that are formed in a familiar spreading dovetail configuration (FIG. 1). This dovetail configuration, which is common on front blade sights for firearms, permits the device 10 to be mounted in a complimentary dovetail groove machined in the barrel of a firearm, and to be adjusted laterally in the groove for windage, as will be explained in more detail hereinbelow.

Upstanding from the base member 14 is a sight member 16. As is apparent from FIG. 1, the sight member 16 has a more or less conventional shape and configuration as far as front blade sights for firearms are concerned, except as will be explained presently. Thus, the sight member 16 has a front end 18 that, in side elevation (FIG. 1), is somewhat rounded and that is adapted to face toward the remote object and away from a sighter's eye when sighting. The sight member 16 also has a rear end 20 that is generally rectilinear in shape and that is adapted to face toward the sighter's eye when sighting. The rearwardly looking face 22 of the sight member 16 is oriented normal to the line of sight of the device 10, which is indicated by the dash-dot line labeled A in FIG. 1.

Intermediate of the front and rear ends of the sight member 16 is a recessed surface 26 that inclines upwardly and rearwardly relative to the line of sight A. As indicated in FIG. 1, the inclined surface 26 is preferably disposed at an angle of about 45° relative to the line of sight A. The inclined surface is plated, coated or otherwise provided with a finish, indicated at 28 in FIG. 1, that is highly reflective of ambient light. Preferably, the finish 28 on the surface 26 exhibits good wear and scratch resistance, and is substantially more reflective than the remaining exposed surfaces of the sight member 16 and base member 14. In the preferred embodiment in which the sight member 16 and base member 14 are machined as an integral unit from a durable metal such as iron or steel, the reflective finish 28 on the surface 26 is provided by a thin plating of polished gold, while the remaining surfaces of the sight member 16 and base member 14 have a dark, non-reflective finish such as a black, blue-black or brown corrosion resistant finish of the type commonly applied to firearm sight parts. Of course, other finishing techniques and other materials, such as polished brass or silver, may be utilized in providing the desired reflective finish 28 on the surface 26 of the sight member 16. It will also be noted that, because the surface 26 is recessed below the top surface of the sight member 16, the likelihood of an object contacting and damaging the finish 28 is quite small.

The rear end 20 of the sight member 16 defines a small diameter aperture 32, the axis of which is generally parallel to the line of sight A. The aperture 32 exposes the reflective finish 28 on the inclined surface 26 of the sight member 16 when the device 10 is viewed from the rear. The aperture 32 is preferably positioned so that it is equally spaced from the top and sides of the rear face 22 of the sight member 16, as indicated in FIG. 2. As can also be appreciated from FIG. 2, the rear sight face 22 provides a contrasting border around the aperture 32, and effectively masks the reflective finish 28 on the inclined surface 26 from view from the rear save for the open area defined by the aperture 32.

Figure 3:
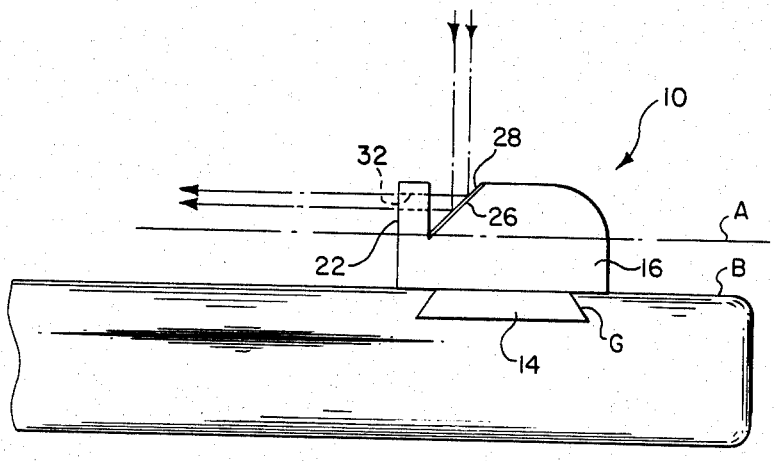
FIG. 3 illustrates the sighting device of FIGS. 1 and 2 mounted to a firearm barrel.

FIG. 3 shows the sighting device 10 of FIGS. 1 and 2 mounted to a barrel B of a firearm. A dovetail groove G having a shape and size complementing that of the base member 14 of the device 10 is machined at the desired mounting position on the top of the barrel B near its forward end. The base member 14 can then be forced into the groove G transversely (i.e., into or out of the plane of FIG. 3) to mount the device 10 relative to the barrel B, as is common with conventional dovetailed front firearm sights. As is also common, the device 10 may be adjusted in the groove G relative to the barrel B to adjust for errors in windage during the initial sighting of the firearm.

As is indicated in FIG. 3, light from above the sighting device 10 impinges upon the reflective finish 28 of the inclined surface 26 from which it is reflected rearwardly. Only that portion of the reflected light that passes through the aperture 32 more or less parallel to the line of sight A is visible from the rear of the device 10. I have found that, by properly selecting the diameter of the aperture 32, the reflected light that passes through the aperture 32 can be made to appear as a sharply defined, fringeless bead that is substantially brighter than the border presented to the shooter by the rear face 22 of the sight member 16. I have also found that this sharply defined, relatively bright bead of light remains readily discernible to a shooter even under ambient light conditions that are so dim that the border presented by the rear face 22 is no longer readily discernible. The bead of light passing through the aperture 32 thus serves as a simple and convenient means for aiding in the accurate sighting of the firearm, and substantially broadens the effective range of ambient light intensities over which such sighting is possible as compared to conventional metallic sights. The effects and advantages obtainable with the sighting device 10 are illustrated with the aid of FIGS. 4 and 5 of the drawing.

Figure 4:
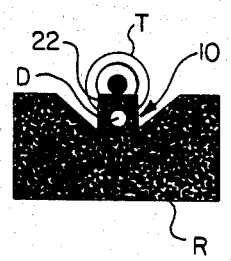
FIG. 4 is an illustration representing the sight picture presented by a sighting device of the type shown in FIGS. 1 through 3 mounted forwardly of a conventional notch sight under bright ambient light conditions.
Figure 5:
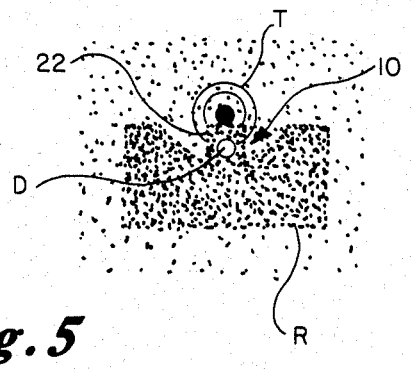
FIG. 5 is an illustration representing the sight picture presented by a sighting device of the type shown in FIGS. 1 through 3 mounted forwardly of a conventional notch sight under dim ambient light conditions.

FIGS. 4 and 5 illustrate sight pictures presented to a firearm shooter aiming at a remote target T with the aid of the sighting device 10 and a conventional notch metallic sight R mounted on a firearm rearwardly of the device 10. FIG. 4 illustrates the sight picture presented to the shooter under bright ambient light conditions in the vicinity of the shooter. FIG. 5 illustrates the sight picture presented to the shooter under dim ambient light conditions in the vicinity of the shooter. The bead of light passing through the aperture 32 is represented by the designation D in FIGS. 4 and 5.

As indicated in FIG. 4, when light conditions near the shooter are bright, the images of the rear face 22 of the lu device 10, the bead D of reflected light passing through the aperture 32, and the rear sight R are all sharply defined and readily discernible in the sight picture. The bead D, which is centered within and sharply contrasts with the dark border of the rear face 22 of the device 10, serves to facilitate the attainment of an accurate windage and elevation sight by permitting the face 22 to be accurately located both horizontally and vertically in the sight picture relative to the remote target T and the rear sight R. Under dim light conditions, the images of the face 22 and the rear sight R are both blurred and difficult to resolve, with the blurring and difficulty in resolution being somewhat more severe for the face 22 which is disposed farther from the shooter's eye. However, the bead D of reflected light still remains relatively bright, sharp and readily discernible, permitting the firearm to be sighted with accuracy relative to the bead D even under such poor conditions.

I have found that an aperture 32 of about 1.5 millimeters in diameter yields the desired effects in terms of the brightness, sharpness and discernibility of the bead D when the device 10 is used in sighting a firearm under varied ambient light conditions. The advantages of the invention can be realized with an aperture 32 of a greater or lesser diameter. The precise aperture diameter selected depends upon a number of factors, including the nominal distance between the sighter's eye and the aperture 32, the width W (FIG. 2) of the sight member 16, the firearm or other equipment with which the device 10 is to be used, and the accuracy demanded of the sight. Generally, as the nominal distance between the sighter's eye and the aperture 32 increases, the diameter of the aperture 32 should also be increased. Thus, for those applications where the sighting device 10 is adapted to be spaced a considerable distance from the sighter's eye, the diameter of the aperture 32 can be quite large. However, for most firearm applications, where the device 10 is typically no more than an arm's length away from the sighter's eye, a particularly useful range of diameters for the aperture 32 in the device 10 appears to be from about 0.75 millimeters to about 2.5 millimeters, with a diameter of about 1.5 millimeters being preferred. With the aperture 32 having the preferred diameter, the width W (FIG. 2) of the sight member 16 is illustratively about 3.0 millimeters. This provides a substantial contrasting border around the aperture 32 which aids in sighting particularly under bright light conditions.

Figure 6:
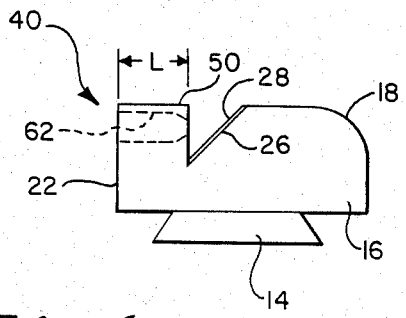
FIG. 6 is a side view of a modified sighting device embodied in accordance with the invention which is also particularly adapted for use as a front blade firearm sight.

FIG. 6 shows a slightly modified embodiment of the invention in the form of a sighting device 40. The device 40, like the device 10 previously described, is particularly adapted for use as a front firearm sight. The device 40 is substantially identical to the device 10, with the identical parts being labeled with identical reference numbers in FIGS. 6 and 1 and 2. Unlike the device 10, however, the device 40 includes a rear end 50 having a length L that is greater than the length of the rear end 20 of the sight member 16 in the device 10. Also, the device 40 includes an aperture 62 that has a relatively large diameter near the rear face 22 and that tapers down to a smaller diameter near the opening facing the reflective finish 28 on the inclined surface 26. I have found that, as the physical length of the aperture increases, reflections of light from the internal walls defining the aperture become significant and tend to degrade the sharpness of the image of the bead D. By widening the diameter of that portion of the aperture spaced away from the surface 26, as in the aperture 62 in the device 40, the effect of these internal reflections on the quality of the image of the bead D is minimized. In the device 40, it is the diameter of the portion of the aperture 62 near the opening facing the reflective finish 28 that is preferably selected to fall within the above discussed useful range.

The sighting devices 10 and 40 may be used in conjunction with rear sights or by themselves. Typically, on firearms such as rifles and hand guns, the devices 10 and 40 are used in conjunction with a rear sight. However, on firearms such as shotguns used for point firing on fast moving targets, the devices 10 and 40 may be used by themselves mounted near the forward end of the barrel. It will be appreciated that accurate sighting can be accomplished even using the devices 10 and 40 by themselves, since the apparent intensity of the bead D of light that passes through the aperture 32 or 62, respectively, will be greatest when the shooter's eye is positioned directly on the line of sight A, and will decrease as the shooter's eye moves off of the line of sight A in any direction in the imaginary plane that is normal to the line A.

Figure 7:
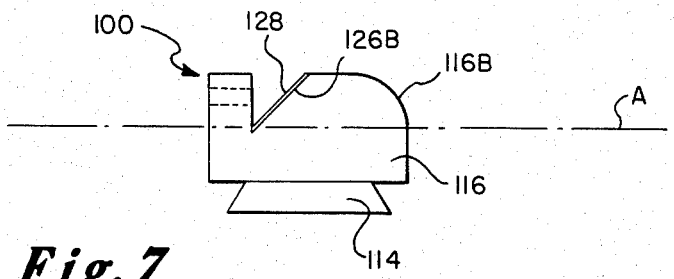
FIG. 7 is a side view of another modified sighting device embodied in accordance with the invention, this one being particularly adapted for use as a rear firearm sight.
Figure 8:
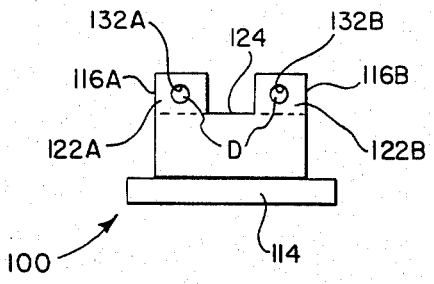
FIG. 8 is a rear view of the sighting device of FIG. 7.
Figure 9:
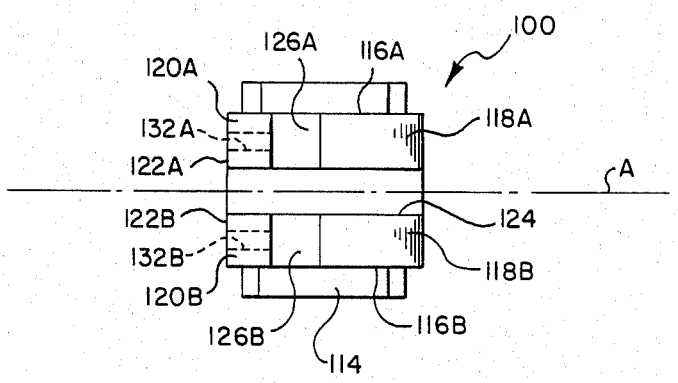
FIG. 9 is a top view of the sighting device of FIGS. 7 and 8.

FIGS. 7 through 9 illustrate another modified sighting device 100 embodied in accordance with the invention. The sighting device 100, unlike the devices 10 and 40 previously described, is particularly adapted for use as a rear sight, that is, as a sight that is mounted rearwardly of a front sight on a firearm.

The device 100 comprises a base member 114 having a dovetail configuration which permits it to be mounted relative to a firearm in a complementary dovetail groove. Upstanding from the base member 114 is a sight member 116 which comprises a pair of spaced apart side sight members 116A and 116B (FIGS. 8 and 9). The side sight members 116A and 116B define a notch 124 that extends through the device 100 parallel to the line of sight A when mounted. The side sight members 116A and 116B each have a front end 118A and 118B, respectively (FIG. 9), adapted to face toward the remote object and away from a shooter's eye when sighting, and a rear end 120A and 120B, respectively (FIG. 9), adapted to face toward the shooter's eye when sighting.

Between the front and rear ends of each of the side sight members 116A and 116B is a recessed surface 126A and 126B, respectively, that inclines upwardly and rearwardly relative to the line of sight A. Each of the surfaces 126A and 126B is preferably disposed at an angle of 45° relative to the line of sight A, and is plated, coated or otherwise provided with a finish, indicated as 128 in FIG. 7, that is highly reflective of ambient light.

Each of the rear ends 120A and 120B defines a small diameter aperture 132A and 132B, respectively, whose axis is generally parallel to the line of sight A. Each aperture 132A and 132B exposes a portion of the reflective finish 128 on its associated inclined surface 126A and 126B, respectively. Each of the rear ends 120A and 120B also includes a rearwardly looking face 122A and 122B, respectively, which masks the reflective finish 128 save for that portion thereof visible from the rear through each of the apertures 132A and 132B.

The diameter of the apertures 132A and 132B are preferably selected using the same considerations previously discussed in connection with the devices 10 and 40. In the case of device 100, however, the apertures 132A and 132B may be of a somewhat smaller diameter (e.g., about 1.0 millimeter) since they are nominally closer to the shooter's eyes when sighting. As can be appreciated from FIG. 8, the notch 124 permits the upstanding sight member of a sighting device, such as device 10 or 40, mounted forwardly of the device 100 to be visible from the rear of device 100 during sighting. As with the devices 10 and 40, light from above the device 100 is reflected rearwardly from the inclined surfaces 126A and 126B, and passes through the apertures 132A and 132B rearwardly toward the shooter's eyes. The light passing through the apertures 132A and 132B appears as a pair of spaced apart beads D (FIG. 8) which are useful in obtaining an accurate sight picture under both light and relatively dim ambient light conditions.

It should be understood that the above-described embodiments are intended to illustrate rather than limit the invention. Various modifications may be made to the described embodiments by those skilled in the art without departing from the scope of the invention, as defined by the appended claims. For example, while the devices 10, 40 and 100 have been shown as having base members with a conventional dovetail mounting configuration, it should be clear that any other of a variety of base member mounting configurations may be used. Thus, base members which permit manual adjustment for windage and elevation may be used with the devices 10, 40 and 100. Also, while the inclined surfaces 26, 126A and 126B on the devices 10, 40 and 100 are shown as being planar, the surfaces 26, 126A and 126B may be segmented or curved so as to collect light from a broader spatial region above the device and to direct that light toward their associated apertures. Furthermore, other aperture shapes may be used instead of circular, including, for example, elongated, triangular or the like. The appended claims are intended to cover these and other modifications as come within the true scope of the invention.

What I claim as new and desire to secure by Letters Patent is:

1. A sighting device for use in combination with a firearm or other such equipment adapted to be sighted to a remote object, said device comprising:

A. a base member for mounting relative to the firearm or other such equipment;

B. an upstanding sight member projecting from said base member, said sight member including i. a front end adapted to face forwardly toward the remote object when said device is mounted, and a rear end, and ii. a surface between said front end and said rear end of said sight member that is inclined so as to face upwardly of said base member and rearwardly of said front end of said sight member, said inclined surface having a finish that is reflective of ambient light so that light from above said device is reflected by said inclined surface rearwardly toward said rear end of said sight member, and C. said rear end of said sight member defining at least one through aperture of circular cross-section defined by a first aperture defining portion located near said inclined surface and a second aperture defining portion located rearwardly of said first portion, said rear end being dimensioned such that it masks said inclined surface from view from the rear of said device except for a portion of said inclined surface that is exposed to view from the rear of said device through the aperture so that light reflected from that portion of said inclined surface passes through the aperture to the rear of said device, the first aperture defining portion having a diameter such that the reflected light passing therethrough defines a relatively sharp bead, and the second aperture defining portion having a diameter that is sufficiently larger than that of the first portion to minimize internal reflection of the light passing therethrough.

2. The sighting device of claim 1 in which said base member has a cross-section that has a dovetail configuration so that said base member can be mounted in a complementary dovetail groove provided in the firearm or other such equipment.

3. The sighting device of claim 1 in which each of said front end and said rear end of said sight member defines a top surface, and in which said inclined surface is recessed below said top surfaces of said front and rear ends of said sight member.

4. The sighting device of claim 1 in which all exposed surfaces of said base member and said sight member except for said inclined surface have a non-reflective finish.

5. The sighting device of claim 4 in which all exposed surfaces of said base member and said sight member except for said inclined surface have a non-reflective finish that is substantially darker in color than the finish on said inclined surface.

6. The sighting device of claim 1 in which said inclined surface is disposed at an angle of about 45 degrees to a line of sight extending from the rear of said device through the aperture in said rear end of said sight member.

7. The sighting device of claim 1 in which the first aperture defining portion of said rear end of said sight member has a diameter in the range of about 0.75 millimeters to about 2.5 millimeters.

8. The sighting device of claim 1 in which the first aperture defining portion of said rear end of said sight member has a diameter of about 1.5 millimeters.

9. The sighting device of claim 1 in which said base member and said sight member are formed as an integral unit.

10. The sighting device of claim 1 in which the reflective finish on said inclined surface of said sight member comprises a layer of gold disposed on said inclined surface.

11. The sighting device of claim 1 in which the reflective finish on said inclined surface of said sight member comprises a layer of polished brass disposed on said inclincd surface.

12. A sighting device for use in combination with a firearm or other such equipment adapted to be sighted to a remote object, said device comprising:

A. a base member for mounting relative to the firearm or other such equipment;

B. an upstanding sight member projecting from said base member, said sight member including i. a front end adapted to face forwardly toward the remote object when said device is mounted, and a rear end, and ii. a surface between said front end and said rear end of said sight member that is inclined so as to face upwardly of said base member and rearwardly of said front end of said sight member, said inclined surface having a finish that is reflective of ambient light so that light from above said device is reflected by said inclined surface rearwardly toward said rear end of said sight member, and C. said rear end of said sight member defining at least two through apertures which a spaced apart from one another and being dimensioned such that said rear end masks said inclined surface from view from the rear of said device except for spaced apart portions of said inclined surface that are exposed to view from the rear of said device through the apertures.

13. The sighting device of claim 12 in which said upstanding sight member comprises a pair of spaced apart side sight members, each of said side sight members including a front end adapted to face forwardly toward the remote object when said device is mounted, a rear end, and one of said inclined reflective surfaces between its front end and its rear end, each of said rear ends of said side sight members defining one of said through apertures.

14. The sighting device of claim 13 in which each of said side sight members defines a top surface, and in which said side sight members define between them a notch that is recessed below said top surfaces.

15. The sighting device of claim 12 in combination with a second sighting device adapted for mounting relative to the firearm or other such equipment in a spaced apart position forwardly of said sighting device of claim 12.

16. A sighting system for use in combination with a firearm or other such equipment adapted to be sighted to a remote object, said sighting system comprising A. a first sighting device adapted for mounting relative to the firearm or other such equipment;

B. a second sighting device adapted for mounting relative to the firearm or other such equipment in a spaced apart position forwardly of said first sighting device;

C. each of said first and second sighting devices including i. a base member, ii. an upstanding sight member projecting from said base member having a front end adapted to face forwardly toward the remote object when said device is mounted, a rear end, and a surface between said front end and said rear end that is inclined so as to face upwardly of said base member and rearwardly of said front end, said inclined surface being reflective of ambient light so that light from above each said device is reflected by said inclined surface rearwardly toward said rear end of said sight member;

D. said rear end of said sight member of said first sighting device defining a centrally disposed notch and at least two through apertures which are spaced apart on respective sides of the notch, each of the apertures exposing to view a portion of said inclined surface when viewed from the rear of said first sighting device; and E. said rear end of said sight member of said second sighting device defining a centrally disposed blade having at least one through aperture which exposes to view a portion of said inclined surface when viewed from the rear of said second sighting device, the blade of said second sighting device being adapted for alignment with the notch of said first sighting device during sighting.

* * * * *